US005261394A

United States Patent [19]

Mulligan et al.

[11] Patent Number: 5,261,394

[45] Date of Patent: Nov. 16, 1993

[54] PERCUSSIVE AID FOR THE TREATMENT OF CHRONIC LUNG DISEASE

[75] Inventors: James C. Mulligan, Raleigh; David P. Colvin, Apex; Virginia S. Colvin; Benjamin T. Gravely, both of Raleigh; Charles J. Lord; David B. Moody, both of Cary; Raymond A. Whitney, Raleigh; William C. Bryan, Baldenboro, all of N.C.

[73] Assignee: Triangle Research and Development Corporation, Raleigh, N.C.

[21] Appl. No.: 769,130

[22] Filed: Sep. 30, 1991

[51] Int. Cl.[5] ..... A61H 23/00; A61H 7/00

[52] U.S. Cl. ..... 128/55; 128/52

[58] Field of Search ..... 128/54, 55, 51, 52, 128/30, 48-50, 44, 67, 32, 34, 716; 482/13

[56] References Cited

U.S. PATENT DOCUMENTS

| | | | |
|---|---|---|---|
| 2,484,306 | 3/1948 | McClain et al. | 128/28 |
| 3,774,598 | 11/1973 | Wilson et al. | 128/52 |
| 4,747,397 | 5/1988 | Magovern | 128/61 |
| 5,088,474 | 2/1992 | Mabuchi et al. | 128/52 |
| 5,097,823 | 3/1992 | Kempler | 128/60 |
| 5,167,226 | 12/1992 | Laroche et al. | 128/52 |

*Primary Examiner*—Stephen R. Crow
*Assistant Examiner*—John P. Leubecker
*Attorney, Agent, or Firm*—Robert G. Rosenthal

[57] ABSTRACT

A percussive aid provides percussive force to aid in the treatment of Cystic Fibrosis and other pulmonary blockage diseases. The device includes a frame with a pair of reciprocating arms mounted thereto at one of their ends. The other end of the arms mount impactor cups. A spring is associated with each of the cups. A drive mechanism is carried by the frame and moves the arms through a predetermined path of travel from a first uncocked position to a second cocked position of maximum deflection wherein the spring is placed in tension when the arm is tripped.

17 Claims, 9 Drawing Sheets

PERCUSSIVE AID FOR THE TREATMENT OF CHRONIC LUNG DISEASE

FIELD OF THE INVENTION

This invention relates generally to the field of the treatment of chronic lung disease and more particularly, to the field of percussive aids used to loosen purulent secretions from the lungs of persons with chronic respiratory diseases such as cystic fibrosis.

BACKGROUND OF THE INVENTION

Respiratory problems afflict many people throughout the world. Many of these respiratory diseases involve obstruction of the bronchial pathways with bronchial secretions or fluids from the lungs. These diseases may include cystic fibrosis (CF), a much more serious disease. More specifically, with CF patients, the bronchial secretions are very thick and collect in the airways. CF patients require one or more daily percussion treatments to their lung in order to assist in the movement of the aforementioned fluids out of the lungs. As a consequence of reduced oxygen intake and frequent lung infection, CF patients tend to be small, frail and have a life expectancy of less than thirty years.

Manual percussion treatments remain the only proven method for obtaining lung clearance. According to this method, a parent or other adult normally uses their cupped hands to percuss the patient over all of the lung areas (front, back and sides). Satisfactory percussion of CF patients typically requires at least thirty minutes of treatments twice daily. This procedure is both tiring to caregiver and patient, but it is critical to the patient's health and survival. Disastrous consequences can result when percussion is not administered correctly or with the proper frequency. It will, therefore, be seen that CF patients are often unable to travel or live alone and be independent as a caregiver must be present to administer percussive treatments daily.

In response to the obvious drawbacks to manual percussion, over the years there have been several attempts to develop a percussive device to facilitate the removal of purulent secretions from the airways of CF patients. It has long been felt that the availability of such a device would enhance a patient's compliance and aid in the removal of secretions from the bronchial airways.

Several prototypes of a percussive vest have been developed. One such device was a pneumatically based vest that provided for oscillating air entry into an inflatable chamber. Unfortunately, the size, cost, and noise produced by this pneumatic device prevented its general application to CF patients.

Another machine used a series of pneumatic impactors on a vest-like device. Twenty-four pneumatic impactors positioned about the vest were activated sequentially and it was believed this sequential/segmental activation would facilitate removal of secretions from peripheral to central airways.

Another device is the hand-held Puritan-Bennett vibrator/percussor that imparts a very limited percussion into the area beneath a single impactor cup. While the frequency of its percussion can be varied over a wide range, the amount of impact force delivered from this device is limited and is, therefore, without significant benefit to many patients.

Accordingly, it is an object of this invention to improve the overall health of CF patients and to improve their quality of life.

It is also an object of this invention to provide an improved system for loosening lung secretions to facilitate their removal from the lung bronchi and thereby improving air flow.

Another object of the present invention is to provide a percussive system for the treatment of CF that is effective.

A further object of the present invention is to provide a percussive system that closely replicates manual percussion, thus simulating percussion as well as resonant vibration.

Yet another object of the present invention is to provide a percussive system that is lightweight, relatively quiet, and easy to handle, which will thereby increase patient compliance.

Still another object of the present invention is to provide a percussive system that is affordable.

A still further object of the present invention is to provide a percussive system that permits patient self treatment and thus permits the patient freedom of movement and independence.

SUMMARY OF THE INVENTION

To accomplish the objects described above, there is provided a portable lightweight percussive aid for use in the external treatment of chronic lung disease in humans by effectively delivering percussive force to the thoracic region of a patient's body. The percussive aid comprises a frame including opposing dorsal and ventral surfaces, opposing sides and opposing ends which together define a cavity. A pair of arms having respective proximal ends and distal ends are provided. The proximate ends of the arms are connected to the dorsal surface proximate each of the sides. A spring means is operatively associated with each of the arms and an impactor cup is connected to each of the arms proximate the distal end thereof. A drive means is carried by the frame for moving each of the respective arms through a predetermined path of travel from a first uncocked position of maximum deflection when the arm is released. Thus, when the percussive aid is placed in contacting relation with the thoracic region of a patient and the respective arms are moved in predetermined sequential relation between an uncocked and a cocked position, where the arm is tripped or released, the arms move between a rest position and a position of maximum deflection and kinetic energy is transferred to the patient to effectively aid in the clearing of bronchial passageways.

BRIEF DESCRIPTION OF THE DRAWINGS

Other objects and advantages of the invention will become apparent upon reading the following detailed description and appended claims, and upon reference to the accompanying drawings in which

DETAIL DESCRIPTION OF THE ILLUSTRATED EMBODIMENT

While the present invention will be described more fully hereinafter with reference to the accompanying drawings, in which a particular embodiment is shown, it is to be understood at the outset that persons skilled in the art may modify the invention herein described while still achieving the favorable results of this invention. Accordingly, the description which follows is to be understood as a broad teaching disclosure directed to persons of skill in the appropriate arts and not as limiting upon the present invention.

Figure 1A:
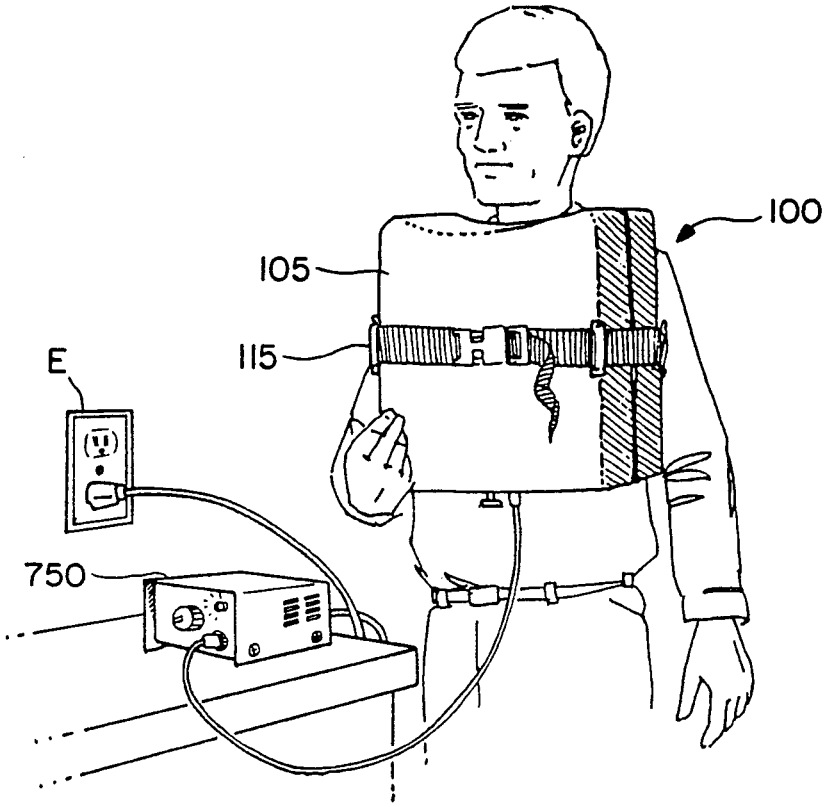
- FIGS. 1*a* and 1*b* are front and rear views, taken in perspective of a patient wearing the percussive aid on the chest which embodies the features of the present invention.
Figure 1B:
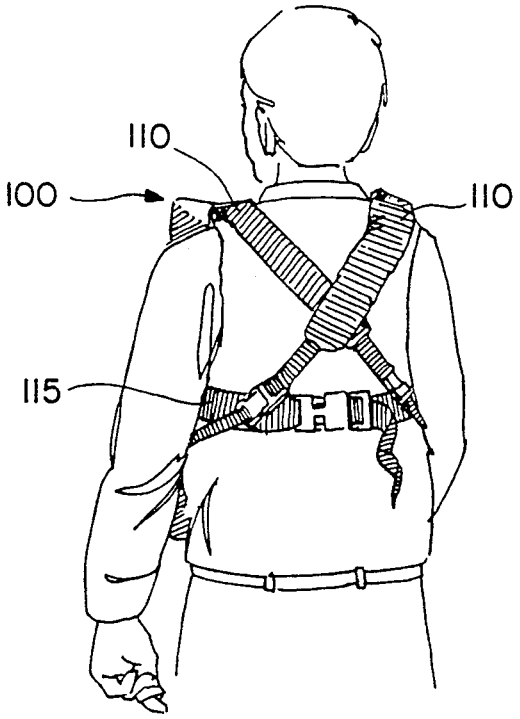

Referring more specifically to the drawings and particularly to FIGS. 1*a* and 1*b*, a percussive aid which embodies the features of the present invention is generally indicated at 100. The percussive aid 100 is generally adapted to be worn like a backpack and to cover portions of the user's thoracic region overlying the lungs including the front, back, and sides. The percussive aid 100 includes a protective cover 105 which substantially covers the device. Openings are provided for the impactor cups to contact the patient, for electrical energy to be provided to the motor and for various adjustments to be made as will be discussed more fully hereinbelow. The cover 105 is preferably fabricated from a flexible, durable material such as denim, canvas, NYLON ® and the like. Also provided, as shown in FIG. 1, are adjustable shoulder and waist straps 110, 115 which allow the percussive aid to be supported by the shoulders and secured about the waist of the patient. Specifically, the shoulder straps are connected in criss-cross fashion and the waist straps include buckles on each side of the device to facilitate use of entry, adjustment and removal thereof.

Referring now to FIGS. 2 through 16, the percussive aid 100 is disclosed therein in detail. The percussive aid comprises a frame means 200, a pair of arm means 300, an impactor cup assembly 400, and a drive means 600.

Figure 2:
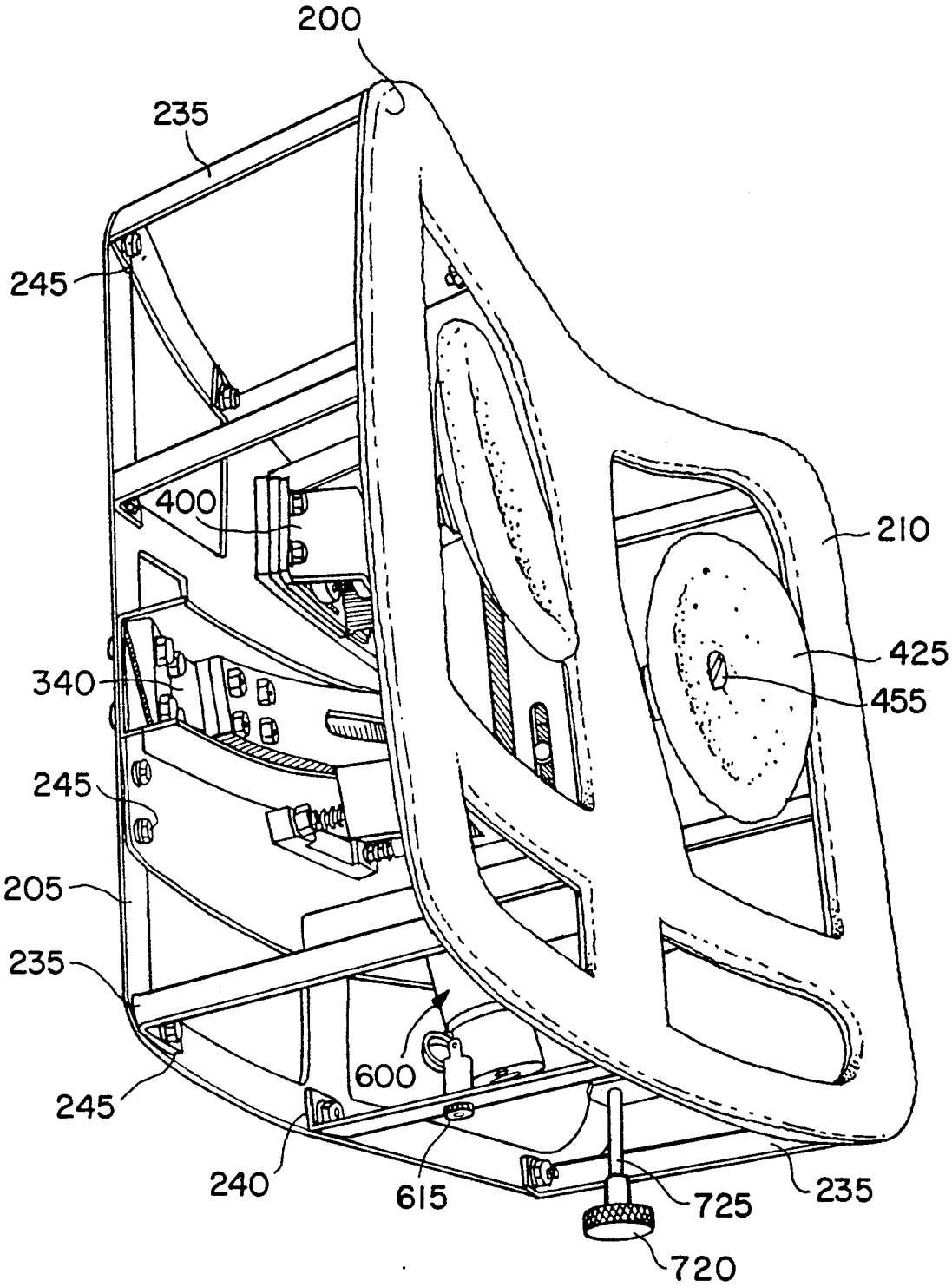
FIG. 2 is a perspective view of the percussive aid of the present invention with the fabric covering and straps removed.
Figure 3:
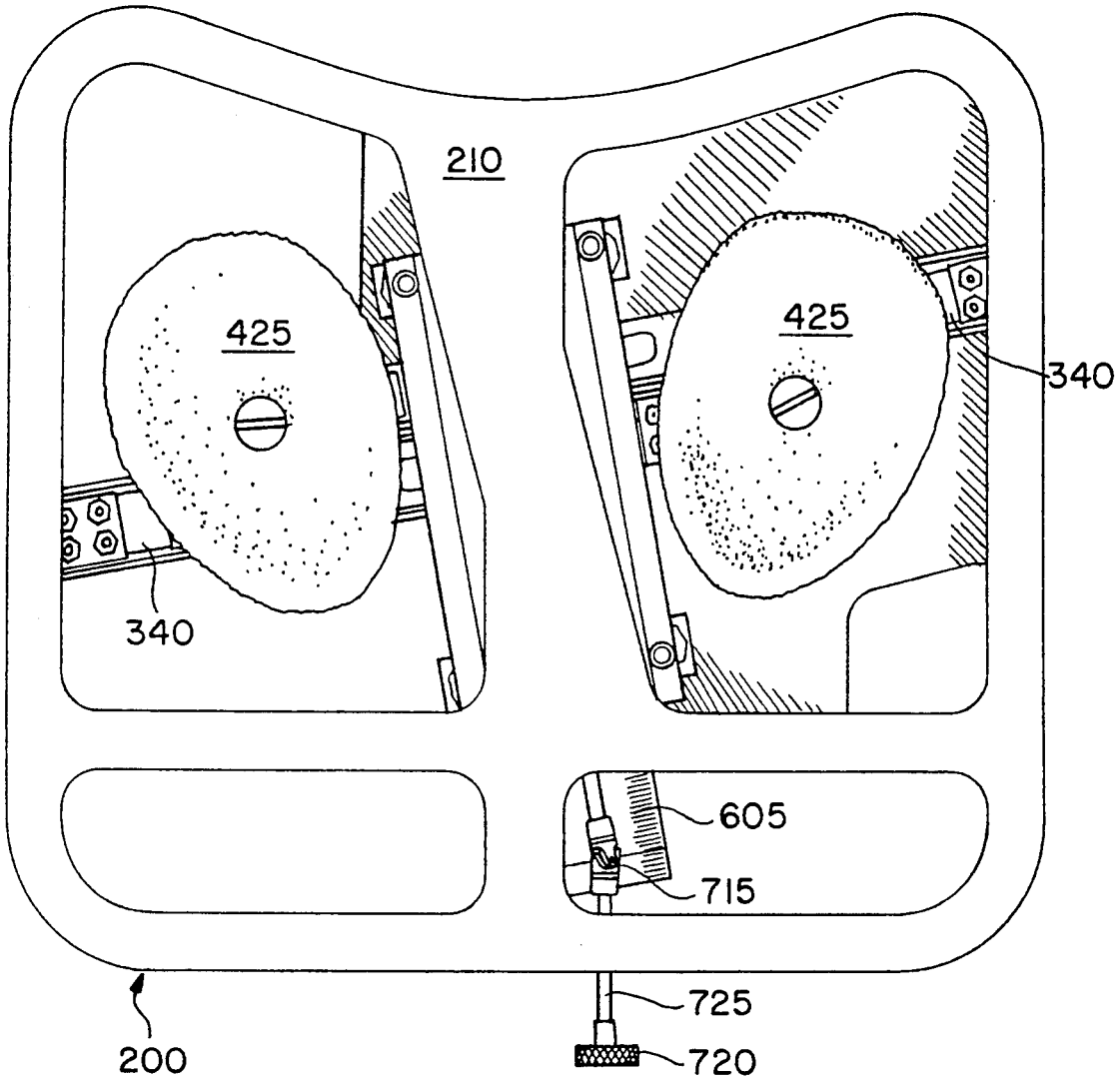
FIG. 3 is a plan view of the percussive aid according to the present invention and illustrating the impactor cups that contact the thorax of the patient.
Figure 4:
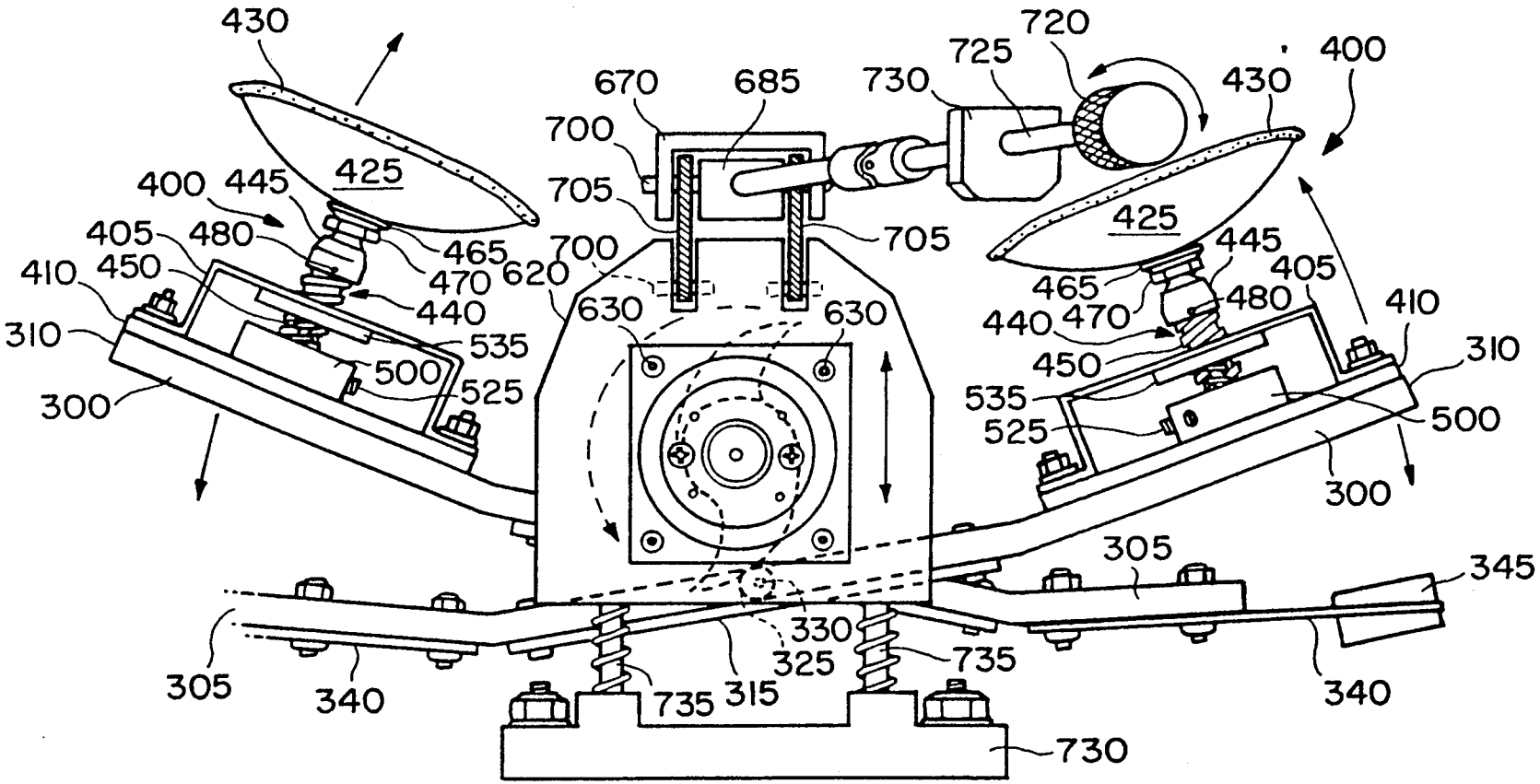
FIG. 4 is a plan view of the percussive aid according to the present invention with the frame removed.
Figure 5:
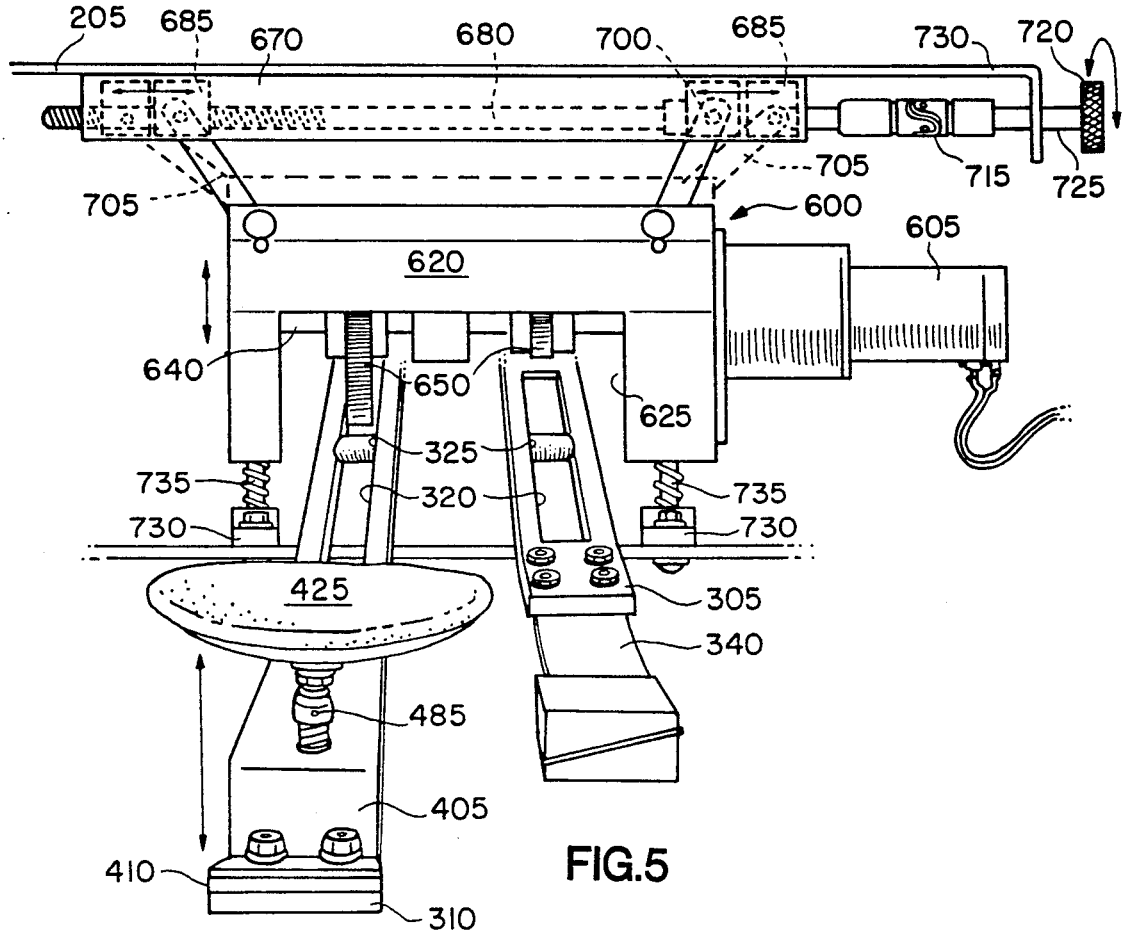
FIG. 5 is a side view of the portion of the percussive aid according to the present invention that controls the stroke length of the arms.
Figure 16:
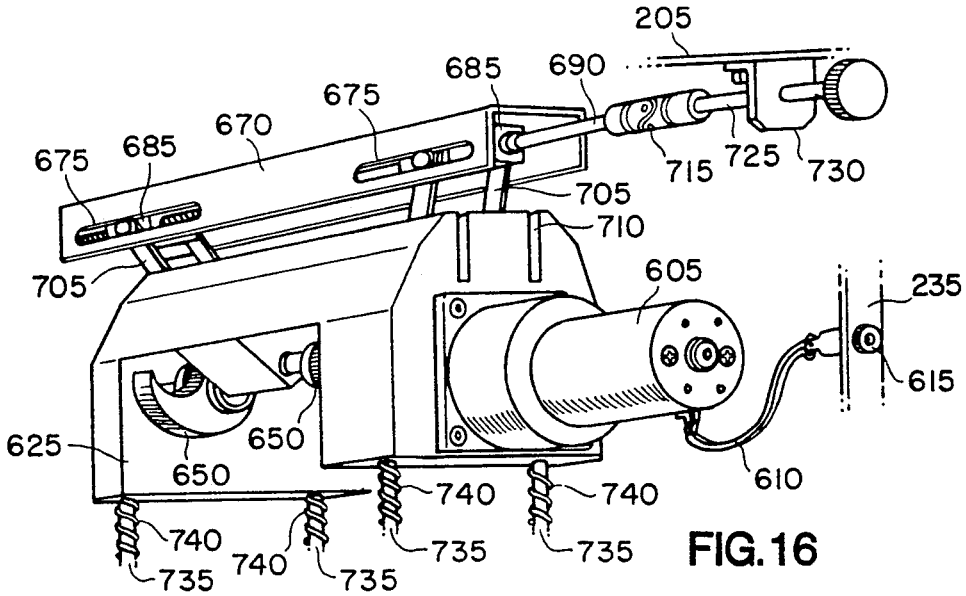
FIG. 16 is a perspective view of a portion of the percussive aid according to the present invention and showing the arm stroke adjustment mechanism.
Figure 9:
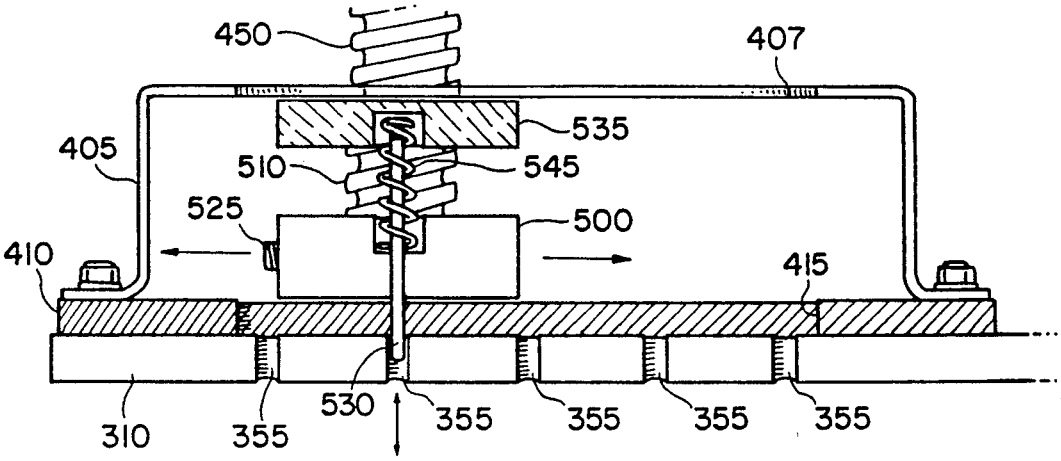
FIG. 9 is a side view partially cut away of one end of an arm according to the present invention and showing in detail the mounting and adjustment mechanism of the impactor cup assembly thereon.
Figure 8:
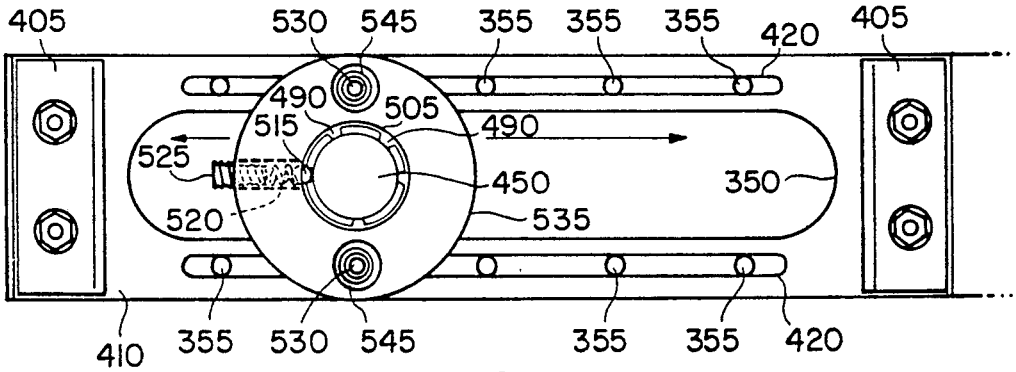
FIG. 8 is a plan view of an end portion of one of the arms of the percussive aid according to the present invention and the mounting and adjustment mechanism of the impactor cup assembly.
Figure 6:
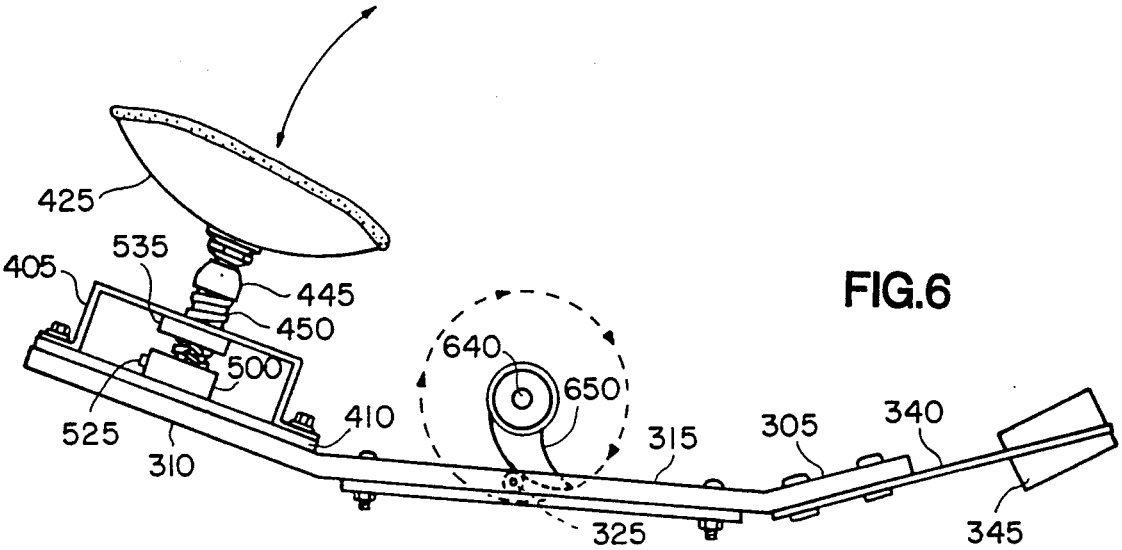
FIG. 6 is a plan view of one of the arms of the percussive aid according to the present invention.
Figure 7:
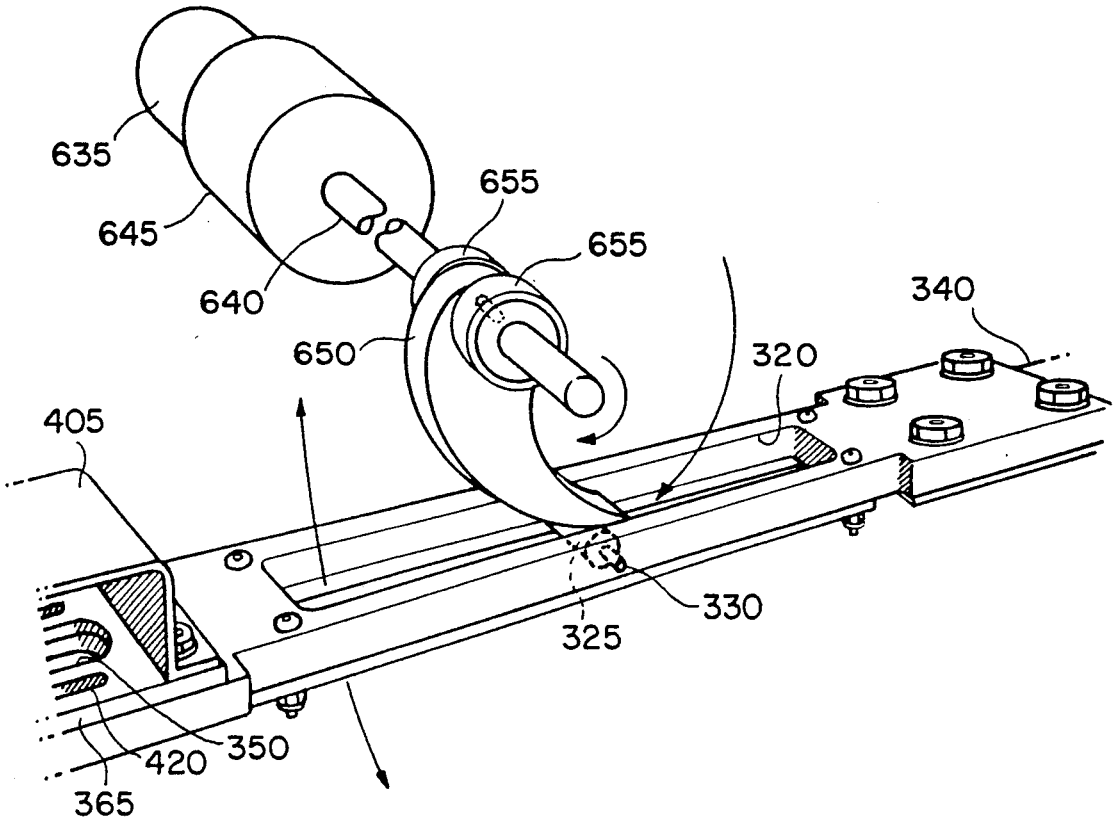
FIG. 7 is a perspective view of a portion of one of the arms of the percussive aid according to the present invention illustrating in detail the cam and cam follower.
Figure 10:
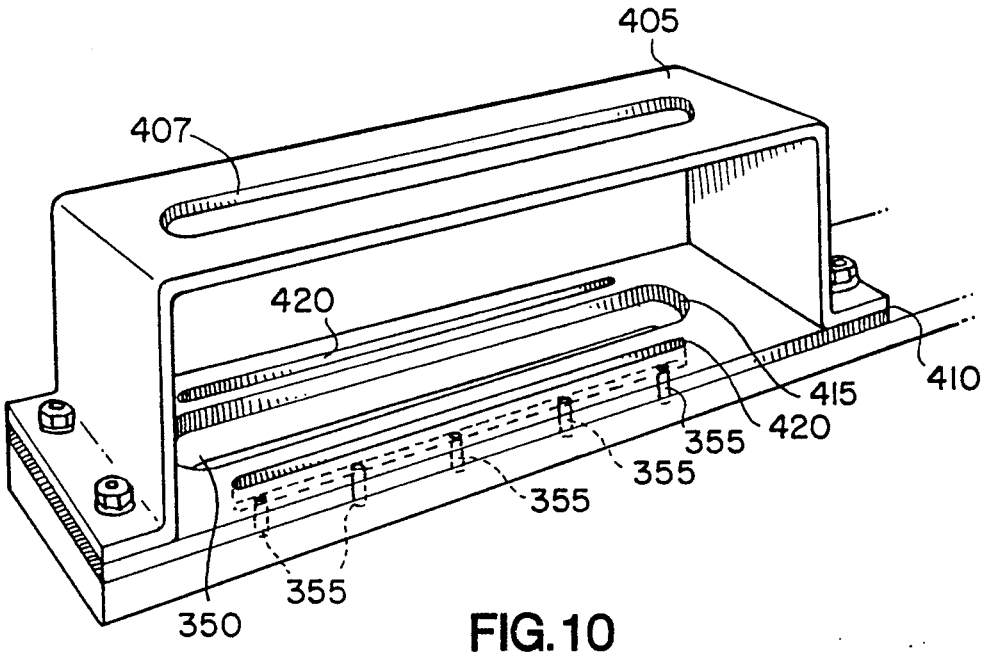
FIG. 10 is a perspective view of the end of an arm of FIG. 9 and showing the parts of the mounting and adjustment mechanism mounted thereon.

The frame means or frame 200 includes opposing dorsal and ventral surfaces or panels 205, 210; opposing sides 215, 220 and opposing ends 225, 230. The panels 225, 230 are curved in a manner that is substantially similar to the curvature of the human torso. Also provided is a number of reinforcing and connecting bars 235 which connect the dorsal and ventral panels 205, 210 together. Each of the bars 235 is an elongated strip having its ends bent and includes a hole defining a screw opening 240. The dorsal and ventral panels 205, 210 also include corresponding openings, each of which is adapted to receive a threaded nut and bolt combination 245 by which the bars are connected to the dorsal and ventral panels 205, 210 as best illustrated in FIG. 2. The ventral panel 210 has an end 225 that includes an inwardly curved portion 250 When the percussive aid 200 is positioned on the patient's chest, this depression comfortably allows space for the patient's chin.

As previously mentioned, cystic fibrosis patients tend to be small and frail. Therefore, in fabricating the present device, all efforts have been made to make the percussive aid as lightweight as possible, without compromising an percussive force output and durability. Therefore, the frame means is substantially open and the dorsal and ventral panels similarly include as much open area as possible. In the prototype that was constructed, aluminum stock was used to create the frame 200, however, it is possible, although at considerable additional expense, to employ fiber containing alloys, high strength plastics, etc., without sacrificing performance. Similarly, the reinforcing bars 160 could be welded to the dorsal and ventral panels, thus, eliminating some weight and possibly simplifying manufacturing.

The percussive aid 100 also includes a pair of elongated arm means or arms, generally indicated at 300. As the arms 300 are essentially identical in form as well as function, the description which follows will describe structurally only one of the arms and wherever possible, where structures are identical, like reference numerals will be employed. Referring now specifically to FIGS. 6 through 10 which best illustrate arm 300. The arm 300 is bent into three distinct sections, namely, a mounting section or proximal end 305, an impactor cup assembly section or distal end 310, and a cam follower section 315. The mounting section 305 includes four screw holes which extend perpendicularly therethrough. The cup assembly section 310 includes two pairs of spaced apart perpendicular screw holes positioned at its opposite ends. The cup assembly section 310 also includes a slot 350 extending along its longitudinal axis and a plurality of locator holes 355 in which the cup assembly 400, to be described, slides and is held in place. Lastly, the arm 300 includes a cam follower section 315 (best illustrated in FIG. 7) which includes a slot 320 extending along a substantial portion of its longitudinal axis. A low friction cam follower 325 such as a NYLON® roller is mounted across slot 320 on a pin 330 extending transversely in the middle of slot 320. Also, as the width of the cam follower section of the arm is narrower than that of each of the respective arm ends 305, 310 additional strength is supplied in the form of a reinforcing brace or bar 335 Which is mounted to the underside of the cam follower section 315 by means of mounting screws and lock washers, etc.

As is best illustrated in FIG. 2, a flat cantilever spring of spring steel 340 requiring fourteen pounds of force nominal to deflect the beam 0.875 inch at a distance of 6.3 inches is operatively associated with the mounting section or proximal end 305 of each of the arms 300. The arm 300 and the leaf spring 340 are connected together at one end of the spring 340 by means of four screws and lock washers. Similarly, the opposite end of the leaf spring terminates in a mounting block 345. The spring 340 and mounting block 345 are both connected to the dorsal panel 205 proximate the outer peripheral edge or end 225 or 230 thereof. The reader will note that the respective ends 305, 310 of each arm are bent slightly inwardly towards each other at an angle that approximates the curvature of the body. The foregoing ensures that the impactor cup (to be described) perpendicularly contacts the thorax of the patient thereby ensuring maximum energy transfer to the patient.

The apparatus also includes an impactor cup means or assembly 400 (best illustrated in FIGS. 6,8,9–14) which is mounted to the cup assembly section or distal end 310 of arm 300. The assembly includes a u-shaped bracket 405 and a brass plate 410 that are bolted to the arm 300. The brass plate 410 also includes a longitudinal slot 415, identical to slot 350 and a pair of elongated guide channels 420 located on opposite sides of slot 415 which extend substantially the entire length thereof. Located beneath each channel in the arm 300 is a series of spaced apart adjustment or locator holes 355 which function as stops for the lateral adjustment of the cup assembly 400 as will be described in greater detail hereinbelow.

Figure 11:
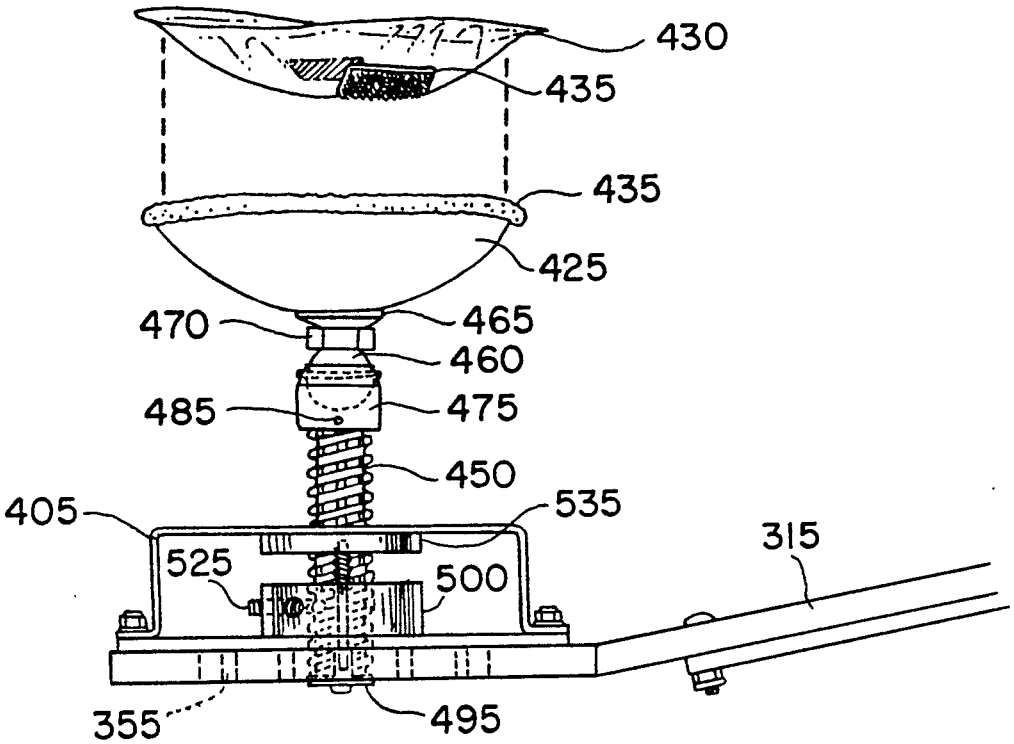
FIG. 11 is a side view of one end of an arm of the percussive aid according to the present invention and showing the impactor cup assembly mounted thereon.
Figure 15:
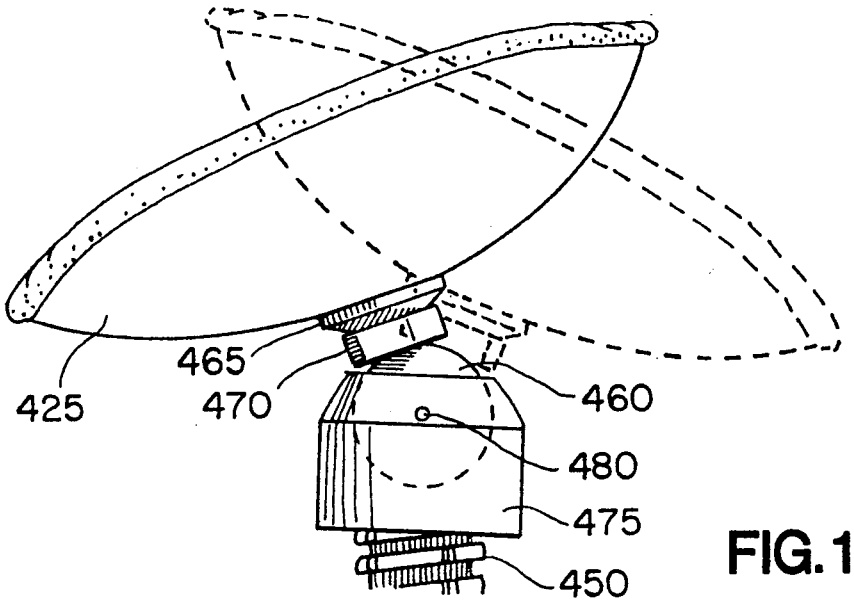
FIG. 15 is a side view of the percussive aid according to the present invention and showing the impactor cup and ball joint swivel mechanism.
Figure 14:
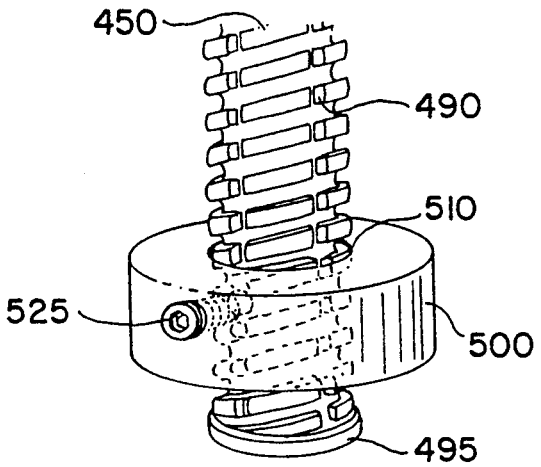
FIG. 14 is a perspective view of FIG. 13 showing the vertical adjustment mechanism of the impactor cup assembly in detail.
Figure 13:
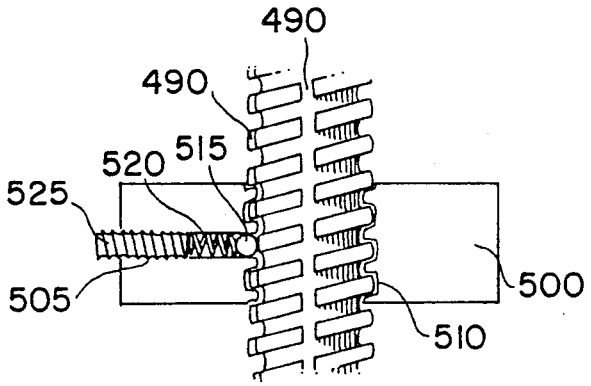
FIG. 13 is a side view, taken in sections of the percussive aid according to the present invention and showing the vertical adjustment mechanism of the impactor cup assembly in detail.
Figure 12:
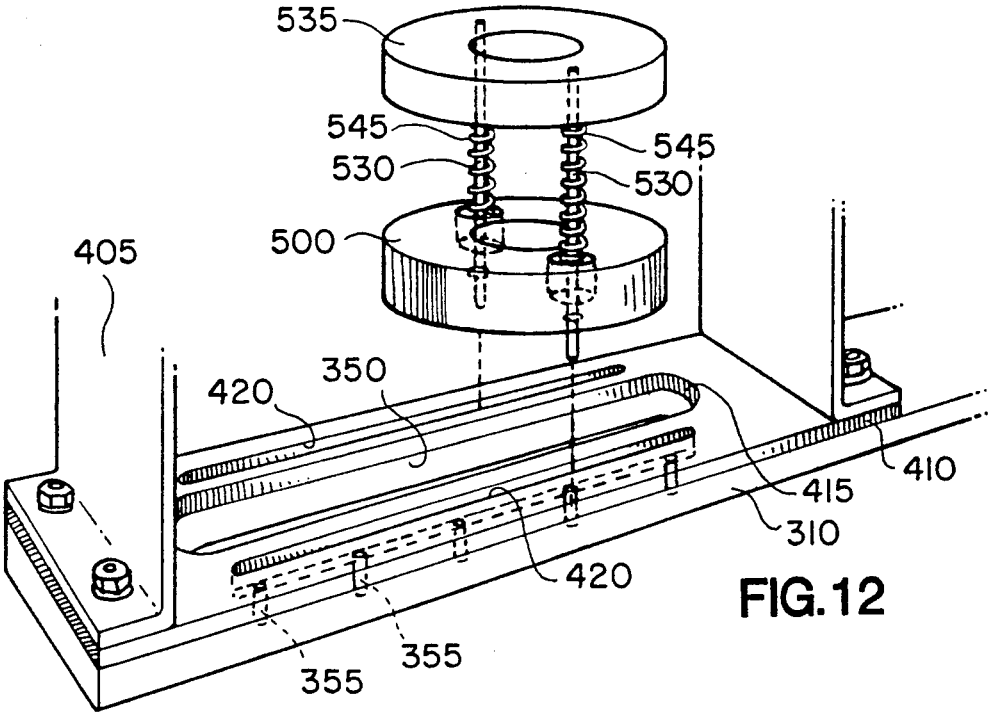
FIG. 12 is an exploded perspective view of one end of an arm of the percussive aid according to the present invention and showing the lateral adjustment mechanism of the impactor cup assembly in detail.

The cup assembly 400 also includes a molded plastic cup 425 which substantially replicates the shape of a cupped human hand as would normally administer manual percussion. The cup 425 is concave in shape and includes a hole or other equivalent mounting provision at its lowest point. A plastic air bag 430 (as shown in FIG. 11) which simulates the "feel" or "popping" generated by manual percussion and is adapted to be removably mounted on the interior of the cup 425 is also shown. The connection between the cup 425 and the air bag 430 may be made by conventional means such as hook and loop fasteners 435 attached to small portions of the opposing surfaces. The cup assists in distributing the impact force over a larger area thereby reducing the need for an air seal around the periphery of the cups.

The cup 425 is mounted to the ball of the socket joint by a screw or bolt as in ordinary practice. In this case, the cup 425 is mounted to a height adjustment means or mechanism 440 which includes a ball and socket joint that is mounted to a threaded screw 450. A flat head screw 455 extends down through the opening in the bottom of the cup 425. The shank portion of the screw mounts a ball 460 and a washer 465 and nut 470 that maintain the screw head in tension with the cup. The socket 475 is mounted on the upper end of threaded screw 450. A pin 480 is inserted in through the socket 475 and extends into the ball 460 to limit the movement of the cup 425 to angular movement about the pin 480. A second pin 485 extends through the socket 475 and into the screw 450 so that the cup 425 and screw 450 rotate together. The screw includes five vertical detente slots 490 that cut into the screw threads and a stop washer mounted at its lower end.

The cup assembly 400 also includes circular nut 500 with a bore 505 extending from the outer perpherial edge to the nut threads 510. The bore 505 receives a ball detente 515, a spring 520, and an Allen nut 525. A pair of press fit locator pins 530 are positioned on opposite sides of the nut 500 and extend upwardly and downwardly therefrom. A low 25 friction washer 535 such as NYLON® substantially identical to nut 500 includes a pair of bores 540 which are positioned to receive the upper ends of the pins 530 and a pair of springs 545 and are positioned on the upper end of the pins 530 between nut 500 and the low friction washer 535.

A drive means 600 is carried by the frame for moving the respective arms 300 through a predetermined path of travel from a first uncocked position to a second cocked position of maximum deflection. When the arm is tripped from the cocked position it moves unimpededly to a contact position wherein the distal end of the arm contacts the patient's thorax. The drive means includes a motor 605 that is adapted to receive electrical energy from an external source 750 through a wire 610 and a plug connector 615 mounted to the frame 200. The power supply is a 75 watt DC power supply having a nominal output of 0–25 volts at 3 amps. Similarly, the motor is a DC gear motor rated at 30 volts maximum having output of 220 ounce-inches of torque at 375 R.P.M. Motors of this type are commercially available from The Pittman Company of Harleyville, Pa. A cam support housing 620 is provided to support the drive means 600 that is substantially rectangular and includes an open cavity 625. The motor 605 is rigidly connected to the cam support housing by means of screws 630 in each corner of the motor mounting base. A motor drive shaft 635 extends through the housing 620 and connects to a cam shaft 640 via means of a bushing 645 (best illustrated in FIG. 7). The cam shaft 640 mounts a pair of spaced apart brass eccentric cams 650 along its length and the far end of the cam shaft terminates in the opposite end of the housing 620. The cams 650 are pinned to the cam shaft. The cams 650 are mounted on the cam shaft 180 degrees out of phase so that the arms 300 alternate between the cocked and uncocked position. A shock absorbing stop 655 is positioned on both sides of the cams 650 to absorb the kinetic energy generated by the moving arms 300 when the device is running without a load (i.e., not contacting the patient).

The drive means 600 also includes means for varying the distance that each of the arms 300 travels between the cocked and uncocked position for varying the kinetic energy delivered to the patient. An elongate u-shaped bracket or base plate 670 is mounted to the center of the ventral panel 210 between the cups by suitable means such as welding. The longitudinal axis of the base plate is canted or angled to the arms. This permits "in-line" positioning of the impactor cups across the patient's torso. This canted or angled positioning of the arms relative to the center line of the frame means or dorsal panel also minimizes mechanical losses due to rotational moments when the impactor cups are not located along the center axis of the arms. The side walls of the base plate includes four longitudinal slots 675 and its ends are open. Mounted within the cavity defined by the base plate 670 is a scissor jack mechanism 680 which includes two screw blocks 685, one of which is mounted near each of the ends and the position of which is adjusted by the turning of the scissor jack transmission 690. Extending through each block 685 and into a corresponding slot 675 is a pin 700 which mounts one end of a link 705. The other end of each link 705 is connected within a corresponding slot 710 in the housing, also by a pin 700. A universal joint 715 is located at the transmission end of the scissor jack screw shaft 680 and a control knob 720 is mounted on a shaft 725 that connects with the opposite end of the universal joint. The bottom of the housing 620 also includes an upwardly extending bore (not shown) near each of its four corners. The housing is also supported from below. A pair of mounting brackets 730 are connected to the dorsal panel 205 beneath opposite ends of the housing. Each mounting bracket includes a vertical bore near each of its ends. The mounting brackets 730 are positioned on the dorsal panel 205 so that the bracket bores underlie the bores in the housing. A rod 735 is press-fit into each of the mounting bracket bores and extends upwardly into the corresponding housing bores. In addition, a spring 740 is mounted around each of the rods 735 and maintains a slight upward pressure on the housing. The foregoing arrangement serves as a stationary mount for the housing when the percussive aid is operating and, further, to assist in adjusting the stroke of the arms.

When it is desired to use the percussive aid, the patient plugs in the power supply 750 to an electrical outlet E. The power supply output is then connected to electrical plug connector 615 on the frame 200. The percussive aid 100 is then placed upon the patient's torso so that cups 425 contact the desired portion of the body with the shoulder straps 100 draped over the patient's shoulders and the waist strap 115 around the patient's torso. The shoulder straps 100 hold the percussive aid at the desired height and the horizontal strap 115 serves to hold the percussive aid 100 in tight contact with the body.

The percussive aid 100 is also adjustable in order to treat patients ranging from small children to adults. Therefore, the position of the cups 425 is adjustable, both as to height as well as lateral position on the arm 300. In addition, the stroke of arms 300 may be adjusted in order to vary the percussive force delivered to the patient. The vertical height of the cups 425 is adjusted by rotating the cup. This will cause the threaded screw 450 to rotate and move up or down. When the desired height is reached, the ball detent 515 assists in holding the cup in the desired position by preventing undesired cup rotation. Similarly, the cup 425 is adjustable laterally along the length of the arm 300. When it is desired to move the cup laterally, upward pressure is exerted on the cup. This causes the nut 535 to be similarly lifted and the pins 530 are removed from the locator holes 355 and places the springs 545 in tension. This frees the cup assembly 400 for lateral movement in slots 415 and 407. The cup is then moved to the desired location along the slots with the washer 535 acting to reduce friction between the retainer spring and the bracket 405. When the desired location is reached, upward pressure on the cup is released and the springs 545 act to re-position the pins 530 within the selected pair of locator holes 355.

The energy delivered to the patient may also be varied by adjusting the stroke of the arms. This is done by rotating control knob 720 which adjusts the position of the screw blocks 685 on the scissor jack 680. This, in turn, adjusts the position of the housing 620 to which the cam shaft 640 and cams 650 are attached. Thus, when the housing 620 is adjusted, the cams 650 move up and down proportionately therewith. As previously mentioned, the cams 650 are eccentric and the amount of deflection of the arms 300 is proportional to the amount of contact that occurs between the cam 650 and the cam follower 325 as the cam rotates. Therefore, the closer to the ventral plate 210 that the housing is positioned, the less the stroke of the cams will be against the cam followers. Conversely, the greater the distance of the housing 620 from the ventral plate 210, the greater the stroke of the cams will be against the cam followers, thus proportionately adjusting the stroke of arms 300.

The device is then placed on the patient and the power supply activated. The voltage to the device is then adjusted to obtain the desired frequency of percussion with the patient. The stroke of the arms may be adjusted while the unit is operating.

Those skilled in the relevant art will recognize that the arms 300 could easily be hingedly connected to the dorsal plate and that a coil spring could be employed to propel the arm upward. In this case, the cams would push the arm downward compressing the spring prior to tripping the same. In addition, the percussive aid could be provided with a drive motor for each arm. In either the dual drive motor example or the single drive motor example illustrated in the drawings, the respective arms may also easily be adapted for synchronous percussion as the medical experts disagree on which method is most effective. Therefore, the foregoing embodiments and examples are to be considered illustrative, rather than restrictive of the invention, and those modifications which come within the meaning and range of equivalence of the claims are to be included therein.

That which is claimed is:

1. A portable, lightweight, percussive aid for use in the external treatment of chronic lung disease in humans by effectively delivering percussive force to the thoracic region of a patient's body and comprising:

a frame means including opposing dorsal and ventral surfaces, opposing sides, and opposing ends which together define a cavity;

first and second arm means having respective proximal ends and distal ends, the proximal end of each of said arm means being connected in cantilever fashion to said frame with said cavity, and wherein said cantilever connection is the sole anchor and support for each of said arm means, each of said arm means being adapted for unimpeded frictionless movement between a cocked position and a contact position, a spring means having a proximal end and a distal end operatively associated with each of said arm means and wherein the proximal end of said spring means cooperates with said frame means and the distal end cooperates with said arm means;

an impactor cup means connected to each of said arm means proximate the distal end thereof, a drive means carried by said frame means for alternately moving each of said respective arm means through a predetermined path of travel from an uncocked position to a cocked position of maximum deflection when said respective arm means is released, whereby when said percussive aid is placed in contacting relation with the thoracic region of a patient and the respective arm means are moved in predetermined sequential relation between the uncocked, cocked and contact positions, kinetic energy is transferred to the patient to effectively aid in the clearing of bronchial passageways.

2. The percussive aid according to claim 1 wherein said impactor cup means are adjustably connected to each of the respective first and second arm means.

3. The percussive aid according to claim 2 wherein said impactor cup means are connected substantially perpendicular to said respective arm means.

4. The percussion aid according to claim 1 wherein said first and second arm means include a cam follower; and wherein said drive means includes a drive shaft mounting a first cam and a second cam that are connected in controlled relation to the respective cam followers to alternatingly move the first and second arm means between the uncocked and cocked positions.

5. The percussive aid according to claim 4 wherein the distance that each of said respective first and second arm means travels between the cocked and contact positions is adjusted by proportionately adjusting the distance that the cam and cam follower are in contact with each other by adjusting the position of the cam relative to the uncocked position of the cam follower, whereby the amount of kinetic energy delivered by each of the arm means may be adjusted for the needs of a particular patient.

6. The percussive aid according to claim 1 wherein the percussive aid further includes means for varying the stroke of each of said respective arm means.

7. The percussive aid according to claim 6 wherein the means for varying the stroke of each of the respective arm means comprises means for adjusting the distance that the respective cams and cam followers are in contacting relation, whereby the amount of kinetic energy delivered by the arm means to the patient by the percussive aid is adjustable.

8. The percussive aid according to claim 1 wherein the proximal end of each of said respective arm means is connected to the dorsal surface proximate each of s id sides.

9. The percussive aid according to claim 8 wherein each of said arm means are parallel with respect to each other and are mounted in canted relation with respect to a center line of said frame means, whereby the impactor cup means contacts the patient at the equivalent positions on opposing sides of the patient's body.

10. The percussive aid according to claim 1 further including air bags adapted to be mounted within each of said cup means.

11. The percussive aid according to claim 1 wherein each of said impactor cup means are mounted for movement between predetermined positions along each of said respective arm means.

12. The percussive aid according to claim 11 wherein each of said impactor cup means are mounted on said arm means for vertical movement to vary the distance between the impactor cup means and the respective arm means.

13. The percussive aid according to claim 12 when each of said impactor cup means are rotatably connected to said arm means to adjust the position of said cup arms with respect to the body contour of the patient.

14. The percussive aid according to claim 1 further including a cover adapted to substantially surround the outer surface of said frame means and including adjustable shoulder straps and adjustable front and rear waist straps, whereby the percussive aid may be easily and quickly positioned and removed from the patient's body.

15. A portable lightweight percussive aid for use in the external treatment of chronic lung disease in humans by effectively delivering percussive force to the thoracic region of a patient's body and comprising:

a lightweight frame means;

a cantilever spring means having a proximal end and a distal end, said proximal end being connected to said frame means;

an elongate arm means having a proximal end and a distal end, said proximal end of said arm means being operatively associated with the distal end of said spring means and including a cam follower; said arm means being adapted for unimpeded frictionless movement between a cocked position and a contact position, said arm means being connected to said frame means in cantilever fashion, said cantilever connection being the sole anchor and support for said arm means, an impactor cup means connected to said arm means proximate the distal end thereof;

a drive means carried by said frame means including a drive shaft mounting a cam that rotates on said cam follower for alternately moving said arm means through a predetermined unimpeded path of travel from an uncocked position to a cocked position of maximum deflection;

whereby when said percussive aid is placed in contacting relation with the thoracic region of a patient and said spring means is moved repeatedly between the cocked and uncocked positions, the arm means moves between a cocked position and a contact position, and kinetic energy is transferred to the patient in a manner which simulates manual percussion to effectively aid in the clearing of bronchial passageways.

16. The percussive aid according to claim 15 wherein said frame means further includes opposing dorsal and ventral surfaces, opposing sides, opposing ends which together define a cavity and wherein said impactor cup means is adapted to move within said cavity a position proximate the dorsal surface when said arm means is in the cocked position to a second position exterior of said cavity which brakes the plane of the ventral surface thereof when said arm means is released and moves to a contact position thereby imparting kinetic energy to the patient.

17. The percussive aid according to claim 16 wherein the distance between the cocked and uncocked positions is adjusted by proportionately adjusting the distance that the cam and cam follower are in contact with each other by adjusting the position of the cam relative to the uncocked position of the cam follower, whereby the amount of kinetic energy delivered by the arm means may be adjusted for the needs of a particular patient.

* * * * *